US009978345B2

(12) United States Patent
Shopa

(10) Patent No.: US 9,978,345 B2
(45) Date of Patent: May 22, 2018

(54) PIANO PLATE ASSEMBLY AND METHOD OF MANUFACTURING SAME

(71) Applicant: Nicholas Joseph Shopa, Brooklyn, NY (US)

(72) Inventor: Nicholas Joseph Shopa, Brooklyn, NY (US)

( * ) Notice: Subject to any disclaimer, the term of this patent is extended or adjusted under 35 U.S.C. 154(b) by 264 days.

(21) Appl. No.: 14/394,904

(22) PCT Filed: Apr. 16, 2013

(86) PCT No.: PCT/US2013/036721

§ 371 (c)(1),
(2) Date: Oct. 16, 2014

(87) PCT Pub. No.: WO2013/158602

PCT Pub. Date: Oct. 24, 2013

(65) Prior Publication Data

US 2015/0068383 A1 Mar. 12, 2015

Related U.S. Application Data

(60) Provisional application No. 61/624,715, filed on Apr. 16, 2012.

(51) Int. Cl.
*G10C 3/02* (2006.01)
*G10C 3/04* (2006.01)

(52) U.S. Cl.
CPC *G10C 3/02* (2013.01); *G10C 3/04* (2013.01)

(58) Field of Classification Search
CPC ... G10C 3/12; G10C 3/02; G10C 1/02; G10C 3/125; G10C 1/00; G10C 3/00; G10C 3/04; G10H 1/32; G10H 2220/221; G10D 13/085; G10D 1/005; G10D 7/005
USPC ..... 84/174, 177–179, 423 R
See application file for complete search history.

(56) References Cited

U.S. PATENT DOCUMENTS 3,058,382 A * 10/1962 Guth ..... G10C 3/163 84/243
3,880,040 A 4/1975 Kaman
4,308,782 A 1/1982 Hartry
4,337,682 A 7/1982 Schwichtenberg
(Continued)

FOREIGN PATENT DOCUMENTS

CN 202887683 U * 4/2013 ..... G01D 1/005
CN 203055885 U * 7/2013 ..... H01L 21/683
(Continued)

OTHER PUBLICATIONS

"Remo Drumhead Selection Guide" (2010) by Remo, Inc., 38 pages. http://drumsonsale.com/DrumResourceRoom/Remo/DH+Mini+Catalog_email_FINAL.pdf.
(Continued)

*Primary Examiner* — Kimberly Lockett
(74) *Attorney, Agent, or Firm* — Buchanan Ingersoll and Rooney PC

(57) ABSTRACT

The present invention relates to improved musical instrument components. In certain embodiments, the present invention relates to a piano plate assembly, wherein the plate assembly comprises a core at least partially surrounded by a shell, wherein the shell comprises a composite fiber material impregnated with a polymeric resin material. In another aspect, the present invention relates to methods of producing such piano plate assemblies.

10 Claims, 3 Drawing Sheets

(56) References Cited

U.S. PATENT DOCUMENTS

| | | | | |
|---|---|---|---|---|
| 4,377,102 | A | 3/1983 | Mayerjak | |
| 4,510,837 | A * | 4/1985 | Keller | G10C 3/04 84/184 |
| 4,969,381 | A | 11/1990 | Decker, Jr. et al. | |
| 5,171,616 | A | 12/1992 | Dejima | |
| 5,581,044 | A | 12/1996 | Belli et al. | |
| 6,297,177 | B1 | 10/2001 | Belli et al. | |
| 6,332,029 | B1 * | 12/2001 | Azima | B42D 15/022 181/166 |
| 6,365,812 | B1 | 4/2002 | McGill | |
| 6,497,598 | B2 | 12/2002 | Affinito | |
| 6,838,606 | B2 | 1/2005 | Chiang | |
| 7,276,868 | B2 | 10/2007 | Allred, III | |
| 7,439,432 | B2 | 10/2008 | Hiraku | |
| 7,795,519 | B2 | 9/2010 | Hsien | |
| 8,148,617 | B2 | 4/2012 | Hashimoto et al. | |
| 2002/0104423 | A1 | 8/2002 | Verd | |
| 2005/0109190 | A1 | 5/2005 | Smith et al. | |
| 2006/0252334 | A1 * | 11/2006 | LoFaro | B32B 5/022 442/400 |
| 2012/0097009 | A1 | 4/2012 | Eventoff et al. | |
| 2012/0180621 | A1 | 7/2012 | Holl | |

FOREIGN PATENT DOCUMENTS

| | | | | |
|---|---|---|---|---|
| GB | 1329817 | A * | 9/1973 | G10D 1/005 |
| GB | 2113888 | A | 8/1983 | |
| GB | 2467372 | A | 8/2010 | |

OTHER PUBLICATIONS

International Search Report (PCT/ISA/210) dated Aug. 2, 2013, by the U.S. Patent Office as the International Searching Authority for International Application No. PCT/US2013/036721.

Written Opinion (PCT/ISA/237) dated Aug. 2, 2013, by the U.S. Patent Office as the International Searching Authority for International Application No. PCT/US2013/036721.

* cited by examiner

PIANO PLATE ASSEMBLY AND METHOD OF MANUFACTURING SAME

FIELD OF THE INVENTION

This invention relates to the field of stringed musical instruments, more specifically to piano plate assemblies and methods of manufacturing the same.

BACKGROUND

In a piano, the steel strings that are struck to produce music need to be held at relatively high tension. Because of that, the strings must be mounted to an apparatus that has high strength and structural integrity. Traditionally, this is accomplished by mounting the strings to a cast-iron plate (sometimes also referred to as a cast-iron frame, though this is technically incorrect as the frame properly refers to the wooden frame of the piano to which the plate mounts), which provides the strength and support necessary to maintain the tension required to hold the strings at their appropriate tuning. These cast-iron plates are typically manufactured in a factory through the multi-step and time-consuming process of pouring molten metal into a cast, cooling over a period of time, sand blasting for smoothing, and then painting, thus making the production of cast-iron plates time consuming and labor intensive. At standard tuning, the plate typically withstands 20 to 30 tons of string tension. This cast-iron plate contributes to over 50% of the instrument's weight.

Because of the relatively large size and weight of pianos, it would be desirable to produce piano parts that are lighter, thereby making the piano easier to move around. However, because of the structural requirements of the plate, producing suitable plates from a lighter material has heretofore been impossible without significantly sacrificing quality.

Thus, there is a need for improved piano components, such as the plate, that provide adequate structural integrity or strength, or even improved structural integrity or strength, while simultaneously reducing the weight and or size of the components or the resulting piano.

SUMMARY OF THE DISCLOSURE

Figure 1:
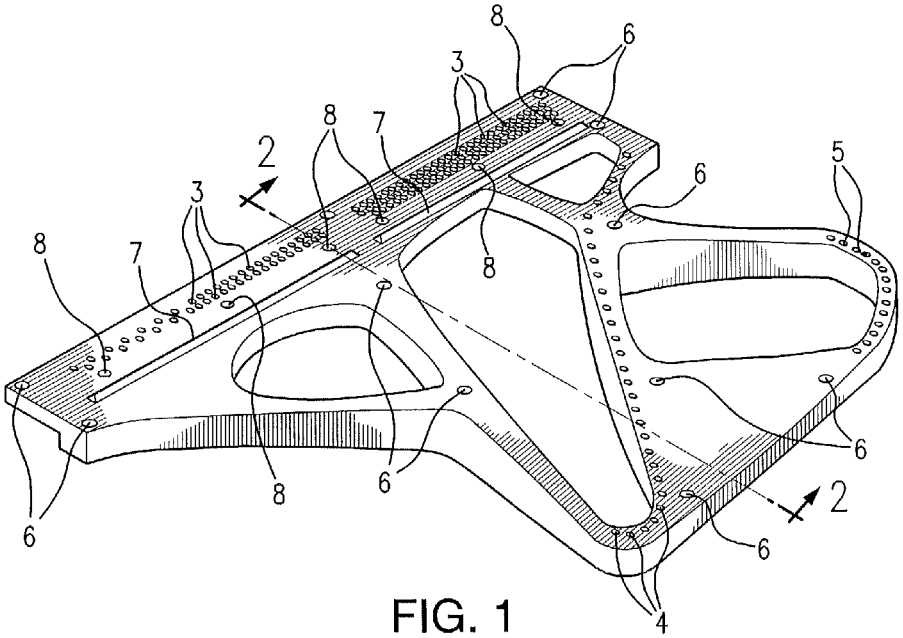
FIG. 1 is a perspective view of a general vertical piano (e.g., upright piano) plate assembly of the present disclosure.

In one aspect, the present disclosure relates to a piano plate assembly comprising a core surrounded on at least one side by a shell, wherein the core comprises a material selected from a dense foam, polymeric material, plastic material, fiberglass sheet material, or some combination thereof; and wherein the shell comprises a composite fiber material impregnated with a polymeric resin. In certain embodiments, the composite fiber material of the shell comprises a material selected from the group consisting of graphite carbon, Kevlar, plastic, Bucky Paper, fiberglass, or some combination thereof. In other embodiments, the shell further comprises a metal material selected from the group consisting of titanium, aluminum, or a combination thereof. In additional embodiments, the shell surrounds both the upper and lower surfaces of the core. In further embodiments, the shell completely surrounds the core. In certain embodiments, the core comprises a solid material or a material comprising a structural shape. In further embodiments, the core material comprises a honeycomb shape.

In additional embodiments, the core comprises a plurality of layers, wherein adjacent layers comprise the same or a different material. In certain examples, the total thickness of the core is less than about 1.5, 2, 2.5, 3, 3.5, 4, 4.5, 5, 6, 7, 8, 9, 10, 11, 12, 13, 14, 15, 16, 17, 18, 19, 20, 21, 22, 23, or 24 inches. In other examples, the total thickness of the core is more than about 1, 1.5, 2, 2.5, 3, 3.5, 4, 4.5, 5, 6, 7, 8, 9, 10, 11, 12, 13, 14, 15, 16, 17, 18, 19, 20, 21, 22, or 23 inches. In certain embodiments, the shell comprises one or more layers of a first shell material at least partially coated with one or more layers of a second shell material, wherein the first and second shell material are the same or different materials. In certain examples, the polymeric resin of the shell comprises an epoxy resin.

In additional embodiments, the plate assembly further comprises one or more suspension rods, cables, or tows. In certain examples, the rods, cables, or tows comprise one or more of titanium, aluminum, graphite fiber, Buckypaper, fiberglass, or plastic, or any combination thereof. In further embodiments, the shell comprises composite fibers, wherein the fibers are aligned in the direction of the greatest load bearing locations in the plate assembly.

In additional embodiments, the plate assembly further comprises a plate bridge comprising a metal or advanced composite material. In certain examples, the plate bridge comprises graphite composite fiber, fiberglass, plastic, Kevlar, Bucky Paper, or any combination thereof. In other examples, the plate bridge comprises a metal-composite material blend.

In certain embodiments, the plate assembly is capable of withstanding at least 20, 21, 22, 23, 24, 25, 26, 27, 28, 29, 30, 31, 32, 33, 34, 35, 36, 37, 38, 39, or 40 tons of tension.

In certain embodiments, the plate comprises one or more through holes, wherein the through holes are introduced by cutting or drilling before the resin bonding stage occurs.

In an additional aspect, the present disclosure relates to a method of producing a piano plate assembly of the present disclosure. In a further aspect, the present disclosure relates to a piano comprising a piano plate assembly of the present disclosure.

DETAILED DESCRIPTION

The present inventors have surprisingly found that a piano plate built of advanced composite materials can be constructed which will replace the cast-iron plate assembly traditionally used in piano construction, and which affords both weight savings and superior structural quality. Yet another surprising advantage of the composite piano plate of the present invention is that the composite plate also secures the tuning stability of the instrument, due in part to the fact that many advanced composite materials, such as graphite carbon fiber, are virtually impervious to temperature and humidity fluxes. Additionally, the composite plate assembly will have essentially no flex under the pressure created by string tension, guaranteeing the highest quality of tuning stableness. Further still, while cast-iron is strong and stiff, it is notoriously brittle and subject to crack, either through the stresses of moving or the continuous pull of strings over time. Such is not the case in the composite plate assembly of the present invention, which ensures long standing tuning stability and overall longevity of the instrument's life and health.

Additionally, such composite plates provide the unexpected advantage of being both more affordable to produce and more easily mass-produced as compared to cast-iron plates. A further surprising advantage of these composite plates is that the sonic integrity of the instrument will remain intact and unaltered by the presence of the composite piano plate assembly, due to the heavy damping quality of many composite materials, such as graphite carbon fiber. Such composite plates are useful in all piano shapes, sizes, and models; both horizontal (e.g., grand) and vertical (e.g., upright). They can also be used in original piano designs, or can be designed to be retrofit in pianos that originally had a east iron plate.

Reference numerals in the figures are used uniformly, such that the same reference numeral always refers to the same portion of the plate. As such, reference numerals used throughout this description refer to the reference numerals in one or more of the provided figures.

Composite plate assemblies of the present invention generally comprise a core material 1 surrounded by a shell material 2. The core 1 may be made of a relatively solid material or may be of a material with a structural shape, such as a honeycomb shaped material. In certain embodiments, the core is made of dense foam, polymeric material, plastic material, fiberglass sheet material, or some combination. In certain embodiments, the core comprises a single layer of material, as shown in FIGS. 2 and 4-6. In other embodiments, the core comprises multiple layers of material, for example 2, 3, 4, 5, 6, 7, 8, 9, 10, or more layers. In some examples, the core comprises multiple layers of the same material, while in other examples the core comprises multiple layers of two or more different materials. In certain preferred embodiments, the core material comprises a single layer of dense foam. Any suitable foam may be used. In certain embodiments, the foam comprises a PVC type foam or a SAN type foam, such as Corecell™ M80 SAN foam. In other embodiments, a polystyrene foam, isocyanurate foam, polyurethane foam, phenolic foam, aluminum foam, carbon fiber foam, or Airex® foam may be employed.

Figure 2:
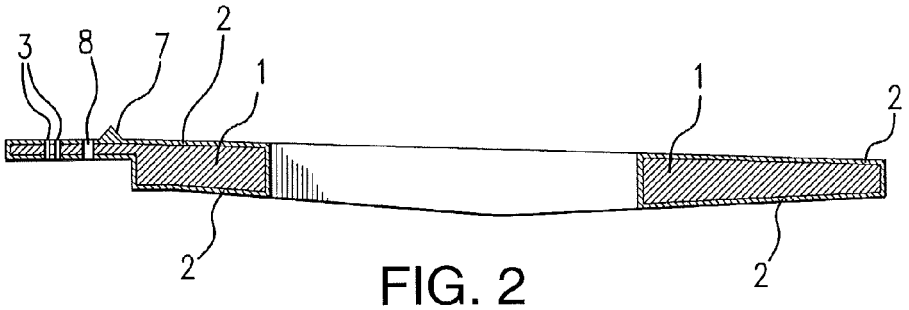
FIG. 2 is a side cross-section view at line 2-2 of the piano plate assembly of FIG. 1 in an embodiment where the core thickness varies and the shell thickness remains constant across the main body of the plate assembly.
Figure 3:
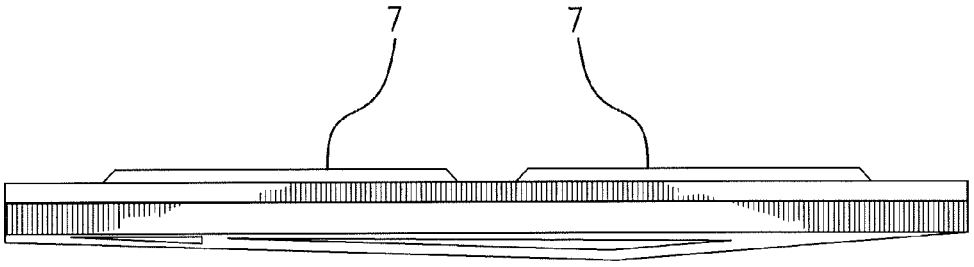
FIG. 3 is a front view of the piano plate assembly of FIG. 1.
Figure 4:
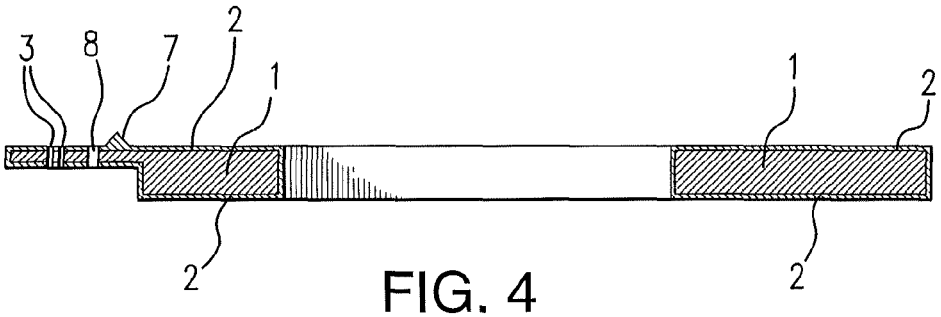
FIG. 4 is a cross-sectional view (as shown in FIG. 2) of a vertical piano plate assembly of the present disclosure which possesses a uniform plate thickness across the main body of the plate assembly.
Figure 5:
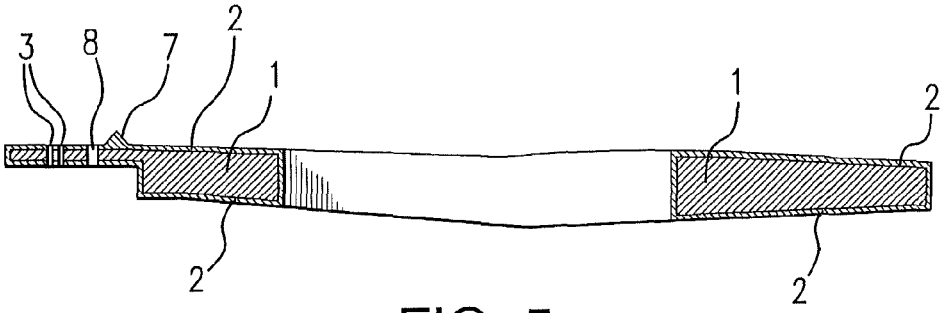
FIG. 5 is a cross-sectional view (as shown in FIG. 2) of a vertical piano plate assembly of the present disclosure where the core thickness varies and the shell thickness remains constant across the main body of the plate assembly.
Figure 6:
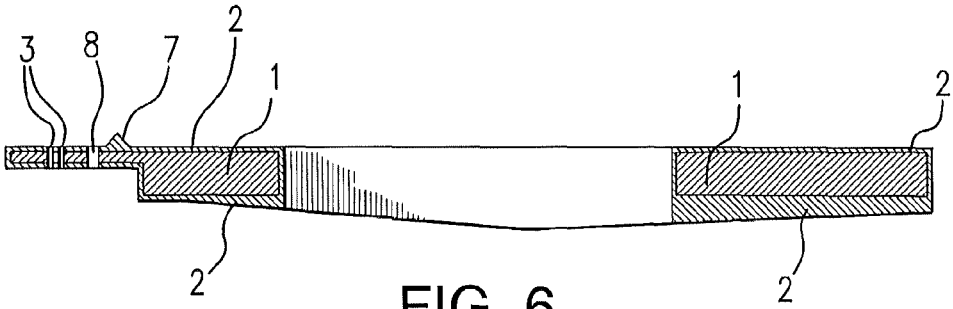
FIG. 6 is a side cross-section view at line 2-2 of the piano plate assembly of FIG. 1 in an embodiment where the shell thickness varies and the core thickness remains constant across the main body of the plate assembly.

The thickness of the core 1 depends on the specific dimensions of the piano into which it is being fitted and the strength per unit thickness of the material chosen. In certain embodiments, the total thickness of the core is between about 1 inch and about 24 inches in thickness. In certain examples, the total thickness of the core is less than about 1.5, 2, 2.5, 3, 3.5, 4, 4.5, 5, 6, 7, 8, 9, 10, 11, 12, 13, 14, 15, 16, 17, 18, 19, 20, 21, 22, 23, or 24 inches. In other embodiments, the total thickness of the core is more than about 1, 1.5, 2, 2.5, 3, 3.5, 4, 4.5, 5, 6, 7, 8, 9, 10, 11, 12, 13, 14, 15, 16, 17, 18, 19, 20, 21, 22, or 23 inches. In certain embodiments, the core is a substantially uniform thickness across the main body of the plate assembly (i.e., area of the plate assembly, excluding the pin block region), as shown in FIGS. 4 and 6. In other embodiments, the thickness of the core material varies across the main body of the plate assembly, as shown in FIGS. 1-3. In some examples, the core material is at a maximum thickness at or near the middle of the plate assembly in the direction of the strings, and decreases in thickness as you move away from the middle, as shown in FIGS. 2 and 5. Such a design may be preferred in certain instances as it provides maximum strength at the area of maximum stress, i.e., the center of the plate in the direction of string tension, while still providing minimum size and weight by decreasing thickness in areas where stress is reduced, i.e., in the vicinity of the points of attachment of the strings. In certain examples, the core material is about 8-24 inches thick near the middle of the plate, tapering to about 1-6 inches thick in the vicinity of the pinblock and about 2-10 inches thick in the vicinity of the hitch pins.

The core 1 is generally at least partially surrounded by one or more layers of a shell material 2 made of an advanced composite material. In certain embodiments, the shell material is on only the two large opposing faces of the core. In other embodiments, the shell completely surrounds the core such that the core is at no point visible after the composite fiber shell has been bonded around it from all angles, as shown in FIGS. 2 and 4-6. In further embodiments, different shell materials can be applied to different parts of the core. For example, one shell material could be used to cover the bottom surface of the core while a different shell material could be used to cover the top surface of the core. In certain embodiments, the shell comprises a single layer of material. In other embodiments, the shell comprises multiple layers of material, for example 2, 3, 4, 5, 6, 7, 8, 9, 10, or more layers. In some examples, the shell comprises multiple layers of the same material, while in other examples the shell comprises multiple layers of two or more different materials. In certain examples comprising a multi-layered shell, one or more layers of one shell material are applied first, followed by one or more layers of a different shell material. In certain examples, the advanced composite material of the shell comprises a graphite fiber composite, plastic, Bucky Paper™, fiberglass composite, or Kevlar composite. In certain embodiments, the composite fiber material may comprise blends of composite materials. In other embodiments, the composite fiber will be reinforced through a bonding or "curing" process where it is infused with a polymeric resin, such as an epoxy resin. In certain examples, the fibers are applied to the core and then are impregnated with the resin directly on the core. In other examples, sheets of fiber which have been pre-impregnated with resin (e.g., pre-preg carbon fiber sheets) may be applied to the core in order to make up the shell material. In certain preferred embodiments, the shell comprises a single layer of a graphite fiber composite material reinforced with an epoxy resin. In certain examples, the shell can comprises one or more sheets of carbon fiber, wherein the sheets comprise carbon fibers of any suitable modulus size. In certain examples, the sheets comprise carbon fibers with a modulus size of 33-100 MSI. In other embodiments, the sheets comprise carbon fibers with a Standard Modulus (33-34 MSI), an Intermediate Modulus (40-42 MSI), or a High Modulus (70-100+MSI). In further embodiments, various sheets with carbon fibers of different modulus can be applied to different areas of the piano plate. The shell may also comprise Buckypaper. In certain embodiments the shell comprises a combination of carbon fiber and Buckypaper.

The thickness of the shell 2 depends on the specific dimensions of the piano into which it is being fitted and the strength per unit thickness of the material chosen. In certain embodiments, the total thickness of the shell is between about 0.125 and 20 inches in thickness. In certain examples, the total thickness of the shell is less than about 20, 18, 16, 14, 12, 10, 9, 8, 7, 6, 5, 4, 3, 2, 1, 0.5, or 0.25 inches. In other embodiments, the total thickness of the shell is more than about 18, 16, 14, 12, 10, 9, 8, 7, 6, 5, 4, 3, 2, 1, 0.5, or 0.25 inches. In certain embodiments, the shell is a substantially uniform thickness across the entire plate assembly, as shown in FIGS. 2, and 5. In other embodiments, the thickness of the shell material varies across the plate assembly. In some examples, the shell material is at a maximum thickness at or near the middle of the plate assembly in the direction of the strings, and decreases in thickness as you move away from the middle, as shown in FIG. 6. Such a design may be preferred in certain instances as it provides maximum strength at the area of maximum stress, e.g., the center of the plate in the direction of string tension, while still providing minimum size and weight by decreasing thickness in areas where stress is reduced, e.g., in the vicinity of the points of attachment of the strings. In instances where the shell thickness varies, the shell may contain more layers of shell material in the areas of thicker shell application. In other examples, different shell materials may be used to make up the extra layers. For example, a plate may be produced by applying an equal number of layers of carbon fiber sheet to the entire core and then one or more layers of Buckypaper may be applied to the areas of increased strain.

In additional embodiments, the plate may comprise suspension rods, cables, or "tows," for example in one or more of the rear, front, sides, and core of the plate assembly. These rods, cables, or tows can be designed such that they counter the calculated stresses of string tension, making the design even stronger still. Persons skilled in the art would be able to determine appropriate locations for such rods, cables, or tows to produce the desired counter pressure. These rods, cables, or tows can be made of any suitable material, and such materials are well known in the art. In certain examples, these rods, cables, or tows may be constructed of a metal material (e.g., steel, titanium, or aluminum), a fiber material (e.g., a carbon fiber, continuous fiber, fiber glass, or Buckypaper), a plastic material, or any other combination of these or other composite materials.

In additional embodiments, the fibers of the composite material may be aligned in the direction of the greatest load bearing locations in the plate assembly in order to provide an overabundance of both strength and stiffness. The orientation of the fibers in such a manner, along with the infusion of resin material, will further ensure essentially no flex in the plate assembly. In certain examples, the directionality of the fibers will run parallel to the piano strings in each given section of the piano (bass strings, tenor strings, and treble strings sections respectively). For example, in an upright piano plate where the piano wire of the bass strings runs diagonally from upper left corner to lower right, so too will the alignment of the fibers in the shell of the plate in this section. Similarly, in a piano plate where the piano wire of the treble strings run vertically, so too will the fibers of the shell run vertically.

In certain embodiments, after application of the shell material, the plate is coated or sprayed, such as with paint, to produce a desired aesthetic property, such as a desired color or texture.

In certain embodiments, the plate is designed such that it is capable of withstanding at least 20, 22, 24, 26, 28, 30, 32, 34, 36, 38, 40, or more tons of tension.

In certain embodiments of the composite plate assembly, one or more holes will be introduced into the plate, such as tuning pin holes 3, hitch pin holes 4 & 5, agraffe holes (not shown), pressure bar holes 8, or mounting holes 6. In certain examples, these holes can be molded directly into the core material. In certain examples, these holes can be drilled through the plate at any stage of production. In some examples, the holes are introduced by cutting or drilling before the resin bonding stage occurs. Introducing the holes at such a stage in the manufacturing process has the unexpected advantage allowing the manufacturer to avoid drilling through the carbon fiber plate assembly after curing, which may compromise the overall structural integrity of the design. In still further embodiments, a threaded (female) insert can be first inserted into the holes, either by placing the insert through a previously formed through hole after the plate assembly is complete or by molding the threaded insert directly into the plate assembly while it is being formed. Such threaded inserts allow threaded (male) bolts, such as tuning pins, agraffes, or hitch pins, to be attached directly to the plate assembly without the need for a separate piece adapted to accept the threads, such as a pinblock.

In certain embodiments, the plate assembly can include tuning pin holes 3, meaning through-holes that allow the tuning pins to protrude through the plate. In the piano construction, these tuning pins will typically be threaded into the pinblock, located adjacent to the plate. Once protruding past the plate, the steel strings of the piano are threaded through an eye in the tuning pin and are wound to tension. Any gap between the tuning pins and the tuning pin holes of the plate can be, in certain examples, occupied by bushings, such as wooden, cork, plastic, or composite bushings.

In additional embodiments, hitch pin holes 4 & 5 can be included, which are capable of accepting a plurality of hitch pins. The function of these hitch pins is to receive the looped end of the strings as a means of anchoring them to the plate. In certain examples, these hitch pin holes will be of the exact same diameter and size as the hitch pins that are to be fit into them to ensure a firm fit. In certain embodiments, the hitch pin holes may be located in several sets at distinct locations on the plate assembly. For instance, looking at FIG. 1, reference numeral 4 depicts the location of the tenor and treble string hitch pins, while reference numeral 5 illustrates where the bass string hitch pins are located. In other embodiments, the fibers in the plate will protrude to form the hitch pins. In further embodiments, the shell material will be molded so as to create molded hitch pins made of the shell material.

In other embodiments, holes introduced into the plate will be mounting holes 6 intended for bolts that will be used to secure the plate to the piano frame. In certain embodiments, the piano soundboard resides intermediate to the plate and frame. In such embodiments, there will be openings cut into the soundboard to allow the bolts to pass through the soundboard and into the frame. In certain examples, the bolts will ultimately anchor into the vertical timbers of the upright piano frame, or, in grand piano models, to the horizontal timbers of the piano frame.

In further embodiments, the plate assembly can include agraffe holes, meaning holes intended to accept agraffes. As is well known in the art, agraffes are guide screws, frequently made of brass, that space and level the strings as they leave the tuning pin in certain types of piano. In other embodiments, the plate assembly can include pressure bar holes 8 to which a pressure bar can be mounted. As is well known in the art, a pressure bar is a bar that applies downward pressure to some or all of the strings after they leave the tuning pins to achieve what is known as "downbearing" in the field. The placement of such holes for agraffes or pressure bars will be readily determinable to persons skilled in the art based on the design of the piano in which the plate assembly is being used.

In certain embodiments, the plate assembly of the present invention will also comprise a plate bridge 7. As is well known in the art, a plate bridge is traditionally the area immediately adjacent the tuning pins where the metal music wire contacts the plate. In order to protect the structural integrity of the composite plate from being grooved by the constant and concentrated pressure of the piano's steel strings in this location, it may be desirable in some or all embodiments to include a plate bridge. A plate bridge useful with the plate assembly of the present invention may comprise any suitable material to provide additional strength to the plate assembly in the area where the strings contact the plate, such as a metal or composite material, or a combination thereof. In certain embodiments, the plate bridge comprises a separate piece of metal or composite material that is attached to the plate assembly after it is constructed. In other embodiments, the plate bridge may be an integral part of the plate assembly, as shown in FIGS. 2 and 4-6. Such integral plate bridges, for example, may be molded into the core or shell material or produced by including an area of additional thickness in the shell material. In certain examples, a thin layer of barrier material, such as a glass resin, may be applied to the surface of the plate bridge to eliminate direct contact between the piano strings and the plate bridge material.

Example

A piano plate assembly for a Young Chang vertical piano, model U-121 will be constructed in the following manner. The plate assembly will have a core cut from a block of polystyrene foam measuring 56 inches long, 45 inches tall, and 4 inches thick. The thickness of the core, once shaped into the appropriate dimensions to fit into the Young Chang, will be approximately 3 inches thick around the area of the hitch pins and around the middle of the core in the direction of string tension, tapering to approximately 0.75 inches thick in the area of the pinblock. The core material will be coated with a shell as follows: 2-3 layers of high modulus composite fiber sheet will surround the entire core with an additional 2-3 layers of high modulus composite fiber in the center of the plate and an additional 1-2 layers in the area of the hitch pins. Each layer will be approximately 0.25 inches thick per side of the plate. As such the total shell thickness will add approximately 1-3 inches to the initial thickness of the foam core (0.25 inches per layer*2-6 layers*2 sides of the plate=1-3 inches), depending on the number of layers applied in a particular area. As such, the overall core will be approximately 2 inches thick in the area of the pinblock, approximately 6 inches thick around the middle of the plate in the direction of string tension, and approximately 5 inches thick in the area of the hitch pins. After application of the shell material, mounting holes 6, tuning pin holes 3, and hitch pin holes 4 and 5 of an appropriate diameter will be pre-drilled through the plate assembly at appropriate positions based upon the mounting bolt, tuning pin, and hitch pin sizes and positions of the piano.

After removal of the keybed assembly, the plate will be positioned within the piano, carefully threading the steel tuning pins through the meticulously allocated tuning pin holes 3 in the composite plate assembly. Once the plate is aligned flush against the pin block with the tuning pins protruding through, tuning pin bushings may be added. With the plate now properly aligned flush with the pin block, and while resting securely on the floor of the piano case, mounting bolts will be inserted through the composite plate's pre-drilled mounting holes 6, to anchor the plate securely to the piano frame. The hitch pins, in models where they do not already protrude from part of the existing plate, may be inserted into the allocated hitch pin holes 4 and 5. The steel strings will then be strung, tenor and treble strings first, as known in the field, and bass strings lastly, as they are strung in a manner which crosses over the tenor strings. The base of the strings are threaded through the bridge pins that protrude from the wooden bridge that is glued to the soundboard, and the looped ends at the bottom of the piano wire are fastened around the hitch pins. Now the keybed may be returned to the frame of the piano, where the keys may be installed, and the action rail assembly (containing the hammers, repetitions, dampers and such) is fit into place. The piano action is secured to the plate with bolts through pre-existing mounting holes 6 in the plate that are specifically designated for such purpose.

What is claimed is:

1. A piano plate assembly comprising a core surrounded on all sides by a shell, wherein the core comprises a dense foam material and the shell comprises a composite fiber material impregnated with a polymeric resin;

wherein the core material varies in thickness such that it is greater than 2 inches thick and less than 5 inches thick in the in the vincinity of the middle of the plate in the direction of string tension, and is less than 2 inches thick in the vicinity of one or both edges of the plate in the direction of string tension;

wherein the shell comprises at least 2 layers of composite material impregnated with a polymeric resin applied on all sides of the core, and wherein the shell thickness is about 0.5-1.5 inches on each side of the core.

2. The piano plate assembly of claim 1, wherein the shell further comprises a metal material selected from the group consisting of titanium, aluminum, or a combination thereof.

3. The piano plate assembly of claim 1 wherein the composite fiber material of the shell comprises a material selected from the group consisting of graphite carbon, Kevlar, plastic, Bucky Paper, fiberglass, or some combination thereof.

4. The piano plate assembly of claim 3, wherein the polymeric resin comprises an epoxy resin.

5. The piano plate assembly of claim 1, wherein the core comprises a plurality of layers, wherein adjacent layers comprise the same or a different material.

6. The piano plate assembly of claim 1, wherein the plate assembly further comprises one or more suspension rods, cables or tows.

7. The piano plate assembly of claim 1, wherein the shell comprises composite fibers, wherein the fibers are aligned in the direction of the greatest load bearing locations in the plate assembly.

8. The piano plate assembly of claim 1, wherein the plate assembly further comprises a plate bridge comprising a metal or advanced composite material.

9. The piano plate assembly of claim 8, wherein the plate bridge comprises graphite composite fiber, fiberglass, plastic, Kevlar, Bucky Paper or any combination thereof.

10. A piano comprising the piano plate assembly of claim 1.

* * * * *